United States Patent [19]

Tschudy

[11] 3,958,299

[45] May 25, 1976

[54] AUXILIARY AIR COOLING SYSTEM FOR CANISTER CLEANERS

[75] Inventor: Donald B. Tschudy, Canton, Ohio

[73] Assignee: The Hoover Company, North Canton, Ohio

[22] Filed: June 24, 1974

[21] Appl. No.: 482,020

Related U.S. Application Data

[62] Division of Ser. No. 397,149, Sept. 13, 1973, Pat. No. 3,874,023.

[52] U.S. Cl. ..... 15/327 A; 15/339

[51] Int. Cl.[2] ..... A47L 7/06; A47L 9/22

[58] Field of Search ..... 15/327 D, 327 E, 327 R, 15/339, 413, 412, 327 A

[56] References Cited

UNITED STATES PATENTS

| | | | |
|---|---|---|---|
| 3,383,765 | 5/1968 | Meltzer | 15/413 X |
| 3,454,978 | 7/1969 | Kuwuhara | 15/327 E |
| 3,733,150 | 5/1973 | Porter et al. | 417/423 X |
| 3,866,263 | 2/1975 | Crouser et al. | 15/327 E X |

FOREIGN PATENTS OR APPLICATIONS

| | | | |
|---|---|---|---|
| 1,628,706 | 5/1971 | Germany | 15/339 |

*Primary Examiner*—Leonard D. Christian
*Assistant Examiner*—C. K. Moore

[57] ABSTRACT

Canister cleaner arrangements are provided in which auxiliary cooling air is introduced to the cleaner main air stream fan system discharge so as to provide a cooled discharge air temperature to maintain cooled portions of the canister cleaner adjacent the fan discharge. In the first embodiment of the invention, auxiliary cooling air flows through perforations in the bottom pan of the cleaner to mix with the fan system discharge air so that the total flow may then be exited outwardly around the periphery of the canister cleaner. In the second embodiment of the invention auxiliary cooling air moves inwardly into the canister cleaner between the bottom pan therefor and an auxiliary pan spaced above the bottom pan to mix with main stream fan discharge air so that the combined air flow can be discharged downwardly through the bottom pan of the cleaner. This provides an air cushion effect for the canister cleaner.

4 Claims, 10 Drawing Figures

FIG. 3
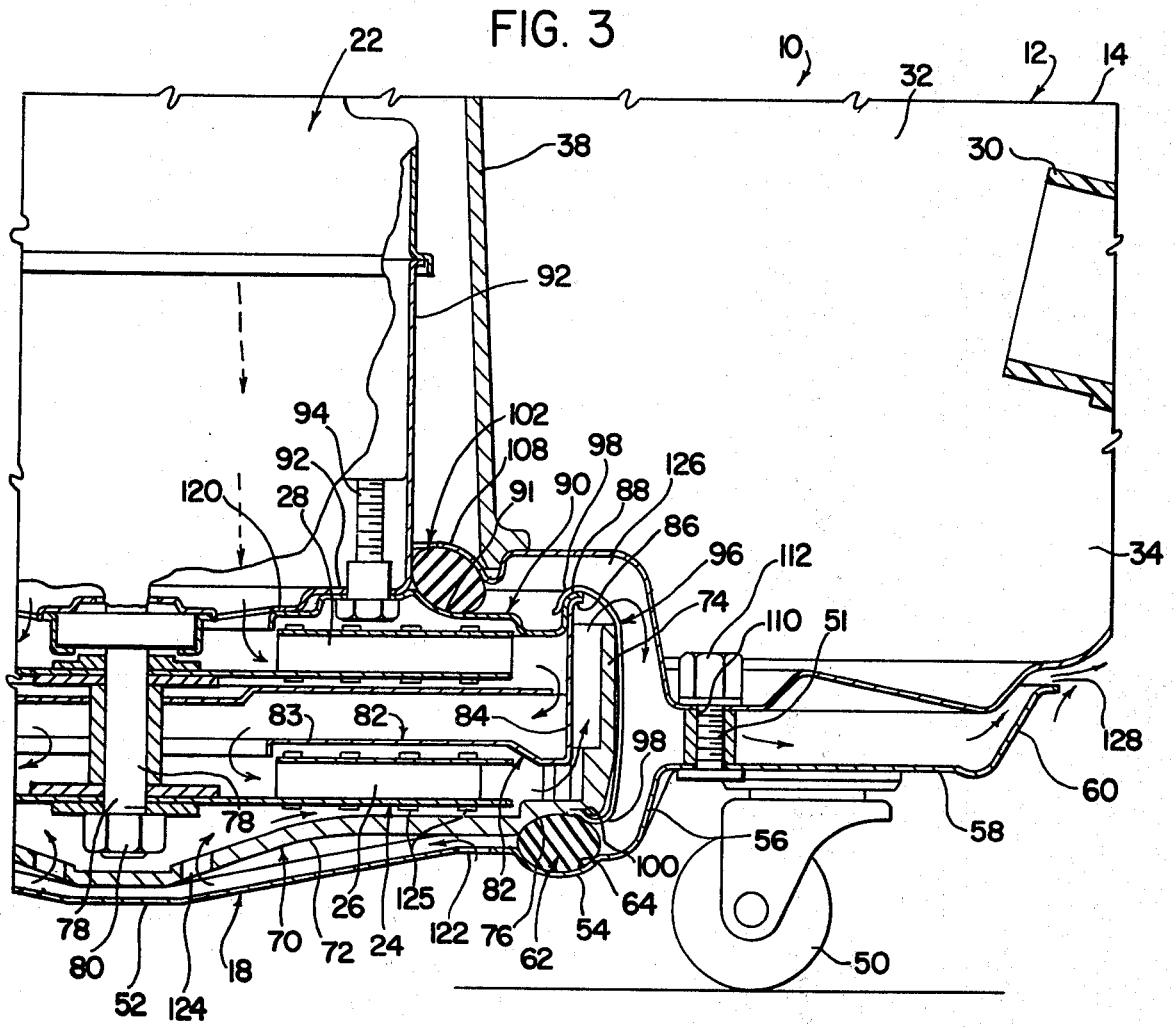
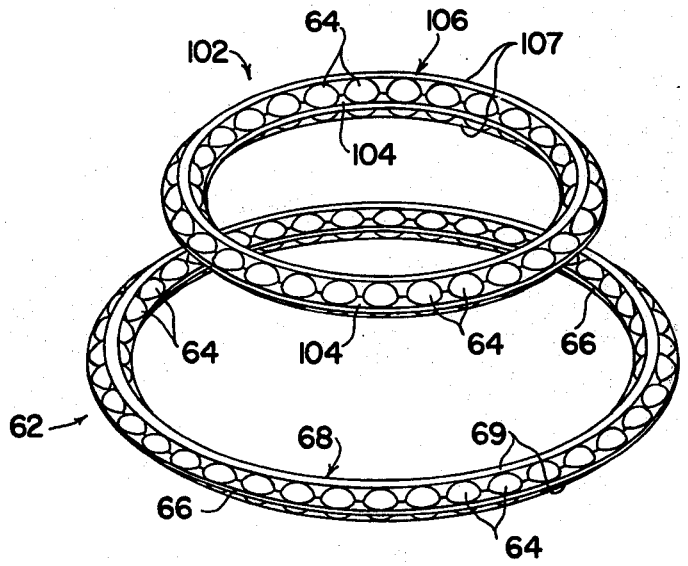
FIG. 4

AUXILIARY AIR COOLING SYSTEM FOR CANISTER CLEANERS

This is a division of application Ser. No. 397,149, filed 13 Sept. 1973 now U.S. Pat. No. 3,874,023, and owned by a common assignee.

BACKGROUND OF THE INVENTION

1. Field of the Invention

This invention relates to vibration suppressing, resilient mounting arrangements and, more particularly, relates to a floor care appliance having a resiliently and sealingly mounted fan and motor system.

2. Description of the Prior Art

The use of resilient mounting arrangements for the isolation of noise and the suppression of vibration are old and well known generally; and, particularly, have been utilized in vacuum cleaners for many years in an attempt to limit the noise produced and make such floor care appliances more acceptable to the housewife-user.

These resilient mounting arrangements have taken many forms through the years from fairly complicated to relatively simplified structures. Such structures, for example, include resilient mounts located at opposite ends of the fan housing resilient mounts located at the bottom of the motor, resilient mounts intermediate to the height of the motor, and resilient mounts at the jointure of the motor and fan housing. All of these enumerated arrangements and others which are known have required some design trade-off during their development so that they suffer at least some inherent design deficiency or lack adaptability when applied to a particularized general style of vacuum cleaner.

More specifically, no canister vacuum cleaner resilient mounting arrangement is known which desirably also provides a sealing function for the fan system, and which has the resilient mounting means disposed so as to minimize the required height and diameter of the motor, resilient support and fan system, and which also has the resilient mounting arrangement arranged to reduce vibrational-caused rocking to a minimum without resort to a maximized lateral extent of the resilient mounts or mounting.

Accordingly, it would be advantageous to provide sucha mounting and resilient suspension system since the cleaner resulting would have obvious improved appearance, simplified design, reduced cost, and improved performance.

Additionally, it would be advantageous to provide such a resilient mounting arrangement since assembly effort would tend to be mimimized making manufacturing of the cleaner easier and faster.

It would be further advantageous to provide such a resilient mounting arrangement since a larger bag volume for a given cleaner outer dimension would result and, thus, housewife effort for bag emptying would be minimized.

It would also be advantageous to provide such a vacuum cleaner resilient and sealing fan and motor supporting arrangement since the number of requisite parts would be reduced, minimizing initial cost and inventory control.

It would be even further advantageous to provide such a resiliently mounted cleaner with a novel cooling air arrangement.

SUMMARY OF THE INVENTION

The invention is provided in a canister or tank-type cleaner having a housing containing the conventional dirt bag, fan, and motor, utilized to perform the normal cleaning function. The motor and fan system are disposed, vertically aligned and generally centrally relative to the cleaner housing, while the disposable bag is contained in a substantially annular chamber extending around the motor housing and between it and the cleaner housing.

In both embodiments of the invention, a pair of resilient mounting rings of generally annular configuration are utilized. These rings are shaped from a series of resilient solid spheres disposed adjacent to one another but in slightly spaced relation, and extending in a ring configuration. Connecting the spheres are a pair of intersecting generally flat bands, one of the bands extending horizontally and annularly with the spheres and cutting across them at their vertical midpoints, and the other band disposed at a right angle and vertically to the first band also cutting across the midpoint of the spheres. These resilient rings are disposed, one generally above and one generally below the fan system for the cleaner. The lower and larger diameter resilient mounting ring is situated between the bottom pan of the cleaner and the bottom side of the diffuser to provide vibration and noise isolation between the lower portion of the fan system and the lower portion (bottom pan) of the cleaner housing. The upper and smaller diameter resilient mounting ring is disposed between a bottom, inwardly turned portion on the intermediate shell of the cleaner housing and the motor mounting plate, disposed below the motor and above the fan system, to provide vibration and noise isolation between the upper portion of the fan system and motor and the upwardly extending remainder of the cleaner housing.

Because of the upper and lower locations of the resilient mounting rings, relative to the fan system, and their interrelation with the bottom pan, diffuser, motor mounting plate and inturned portions of the intermediate shell, these resilient rings also serve as a sealing means to insure the proper passage of fan-induced air flow through and outwardly of the cleaner.

The relative difference in diameters of the resilient mounting rings and thereby the transverse displacement of their ring-like cross sections and their specific locations also gives the effect of a much greater width dimension of vibration supression means to thereby greatly attenuate vibration induced rocking and also considerably reduce the overall requisite dimensional extent of the resilient support motor-fan system mounting to provide a low and relatively small diameter cleaner for a given annular cleaner bag-receiving volume.

In the first embodiment of the invention, a multistage fan system is utilized to provide a cleaner of high performance, with air discharge from this system substantially radially around an annular periphery between the bottom pan and the lower inturned portion of the intermediate shell. An induced flow of cooling air for cleaner discharge air may be led through the bottom portion of the bottom pan and inwardly to the fan system through a diffuser for this system.

In a second embodiment of the invention, a single-stage fan system is utilized to provide a cleaner with relatively lower performance and also cost. Discharge of air from this system is downwardly through an orifice in the bottom pan so that a cushion of air is formed beneath the cleaner to give it an "air ride" characteristic. A supplemental pan disposed between the bottom pan and intermediate shell permits the entrance of cooling air for cooling cleaner air discharge. This air enters the cleaner radially around an annular periphery between the outer diametric extents of the bottom pan and supplemental pan. This cooling air then passes between these members to enter the fan system, proper, through the diffuser therefor.

DESCRIPTION OF THE DRAWINGS

Reference may now be had to the accompanying drawings for a better understanding of the invention, both as to the organization and function, with the illustration being only exemplary, and in which;

FIG. 3 is a fragmentary, elevational, cross-sectional view of a portion of FIG. 1, with the same enlarged;

FIG. 4 is a perspective view of the resilient ring members utilized in the first embodiment of the invention;

DESCRIPTION OF THE FIRST EMBODIMENT

Figure 1:
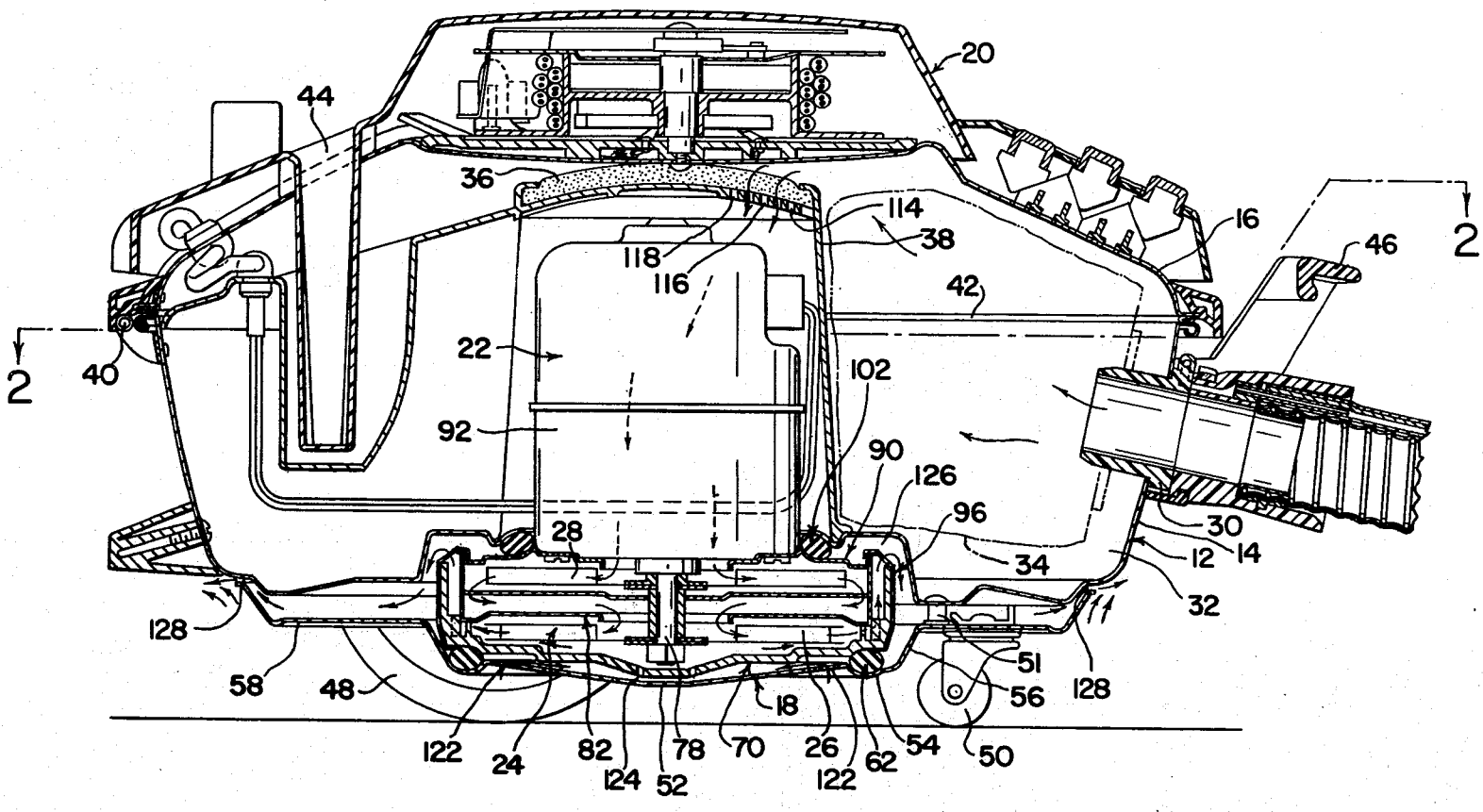
FIG. 1 is an elevational, cross-sectional view of the cleaner of the first embodiment.
Figure 2:
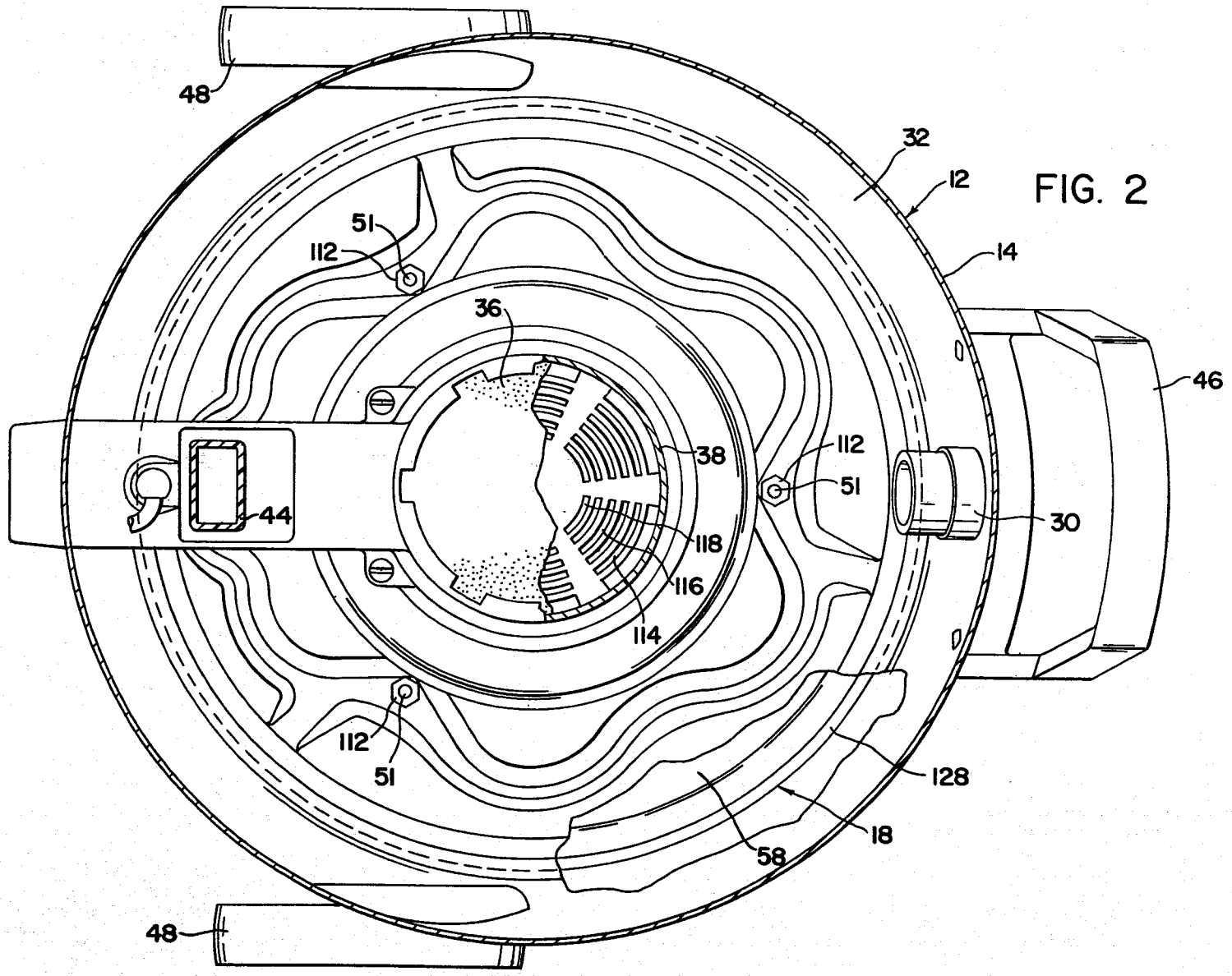
FIG. 2 is a plan cross-sectional view of the cleaner of the first embodiment taken on line 2—2 of FIG. 1.

Referring now specifically to FIGS. 1 to 3 of the appendant drawings, it can be seen that a canister cleaner 10 is provided having a generally cylindrical housing 12 comprised of an intermediate shell 14, an upper shell 16, a bottom pan 18, and a medallion section 20. Conveniently disposed within the housing 12 is a motor 22 that provides the driving force for a fan system 24 having a pair of fans 26 and 28 so that the high performance of a two-stage fan system may be had with the cleaner 10.

A hose coupling fitting 30 communicates with the interior of canister cleaner housing 12 so that suction cleaning air is led through intermediate shell 14 to a generally annular bag-containing chamber 32 in which is disposed a dirt-collecting bag 34. The flow of cleaning air is through hose coupling fitting 30, through dirt-collecting bag 34, through a secondary filter 36 mounted at the top of a housing 38 for motor 22, and then through the motor 22 and fan system 24 to be discharged from the cleaner in a manner to be later described.

A hinge 40 mounts the upper shell 16 to the intermediate shell 14 of the housing 12 so that the canister cleaner 10 may be opened and the dirt-collecting bag 34 replaced when necessary. A sealing gasket 42, disposed between the upper and intermediate shells, insures an airtight jointure between these two shells at their common, abutting edges. A storage tool well 44, disposed in the upper shell 16, provides a means for the easy insertion of a cleaning tool or the like, with this tool well extending vertically into a pocket, sealed with respect to chamber 32 and serving to interrupt its annular configuration.

Canister cleaner 10 also includes a handle 46, attached to intermediate shell 14, that provides a grasping means for the user of the cleaner. A pair of large transport rear wheels 48, 48 (only one shown) and a medially disposed front caster wheel 50 are rotatably connected to housing 12, with these wheels providing ground-engaging contact for the canister cleaner 10 so that it may be easily moved from room to room for cleaning purposes.

Insofar as related, the general configuration of canister cleaner 10 is conventional, with the inventive aspects of the instant embodiment yet to be described. Proceeding now with that description, it can be seen that the fan system 24 and electric motor 22 of canister cleaner 10 receive their support from the bottom pan 18 through the aegis of the wheels 48, 48 acting through the intermediate shell 14 and the wheel 50 supporting the bottom pan 18 above the floor. Thus, the bottom pan 18 serves as the primary support means for the moving elements of the cleaner 10. Bottom pan 18 is generally circular in plan and includes a central, partially dome-shaped section 52, which dome provides for clearance for the part above it. Integrally joined to dome-shaped section 52 is an annularly extending, receiving grooved section 54 that provides a reception means for one of the resilient mounting rings of the invention. Outwardly of grooved section 54 of bottom pan 18 is a tapered section 56 that extends upwardly and radially outwardly and merges into a flattened annularly extending section 58 on which caster wheel 52 is mounted in an upper offset relation, relative to the major extent of bottom pan 18. Outwardly of flattened section 58, another integrally joined tapered section 60 is disposed, with the same extending upwardly at an angle to form a guide for the peripheral discharge of cleaner air (to be described later) and to present a more attractive appearance to the outer periphery of the cleaner.

Figure 4D:
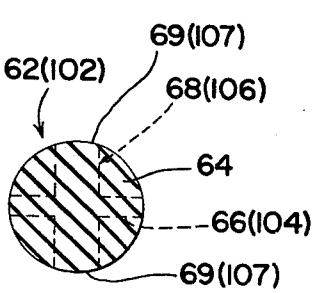
FIG. 4D is a view similar to FIG. 4C but taken on line 4D—4D.
Figure 4C:
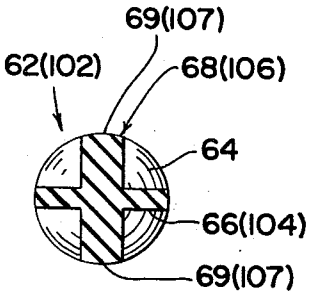
FIG. 4C is a cross-sectional elevational view of the ring member taken on line 4C—4C of FIG. 4B.
Figure 4A:
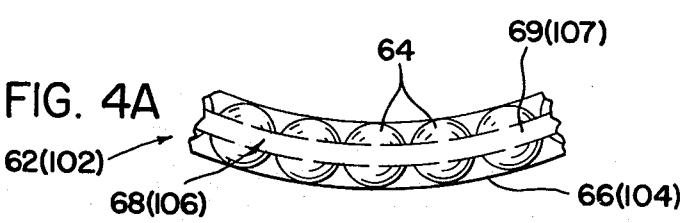
FIG. 4A is a fragmentary, plan view of a typical resilient ring member utilized in the invention.
Figure 4B:
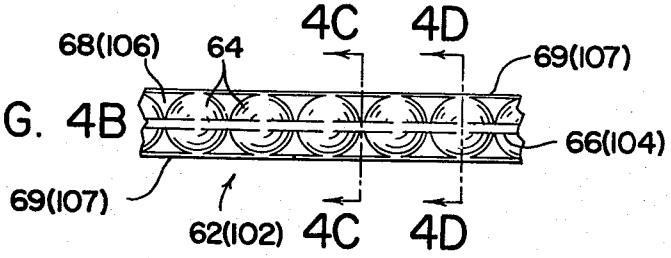
FIG. 4B is a fragmentary, elevational view of the ring member.

Disposed in receiving grooved section 54 of bottom pan 18 is a resilient annular ring member 62 that forms the first, lower resilient support means for the motor 22 and fan system 24 of the canister cleaner 10. This resilient annular ring member takes its shape (FIGS. 4–4D) from a series of spaced, solid, resilient material spheres 64 that are arranged in a circle and integrally joined by a horizontally extending thin, flat, annular ring 66 of the same material, disposed centrally relative to the height of spheres 64 so as to, in effect, cut the spheres into vertically attached hemispheres. The inner and outer peripheries of the annular ring form a circumference equal to the general circumference of the spaced spheres 64. Also integral with the spheres 64 is another resilient ring 68 that extends vertically to form a cylinder of short height and to join the spheres 64 vertically and, in effect, to divide the spheres into horizontally attached hemispheres. The top and bottom edges of ring 68 are flat and generally tangent to the spheres 64 at their connection points thereto.

The configuration adopted for the resilient annular ring member 62 provides a relatively soft, resilient support, but permits the use of a relatively hard (high durometer 35–40 Scale A) natural rubber or other relatively hard, resilient material having a higher durability than a soft, resilient material and, therefore, a longer service life. It should also be noted that the vertical ring 68 is thicker in cross section than the horizontal ring 66 so that the total resilient supportive effect is slightly stiffer in the vertical weight-bearing direction than the horizontal direction and so that the upper and lower terminations of vertical ring 68 form faces 69, 69 having sufficiently extensive bearing area to provide good sealing characteristics.

Mounted on and supported by the resilent ring member 62 is a diffuser 70 of disked, horizontal extent that forms a part (second stage diffusion) of fan system 24. This diffuser includes a horizontally extending bottom plate 72 integrally attached to a thin side-walled, cylindrical portion 74 extending vertically a sufficient extent so as to receive the fans 26, 28 within its confines. A receiving grooved portion 76, extending annularly in the bottom plate 72 of diffuser 70, houses the upper half of resilient ring member 62. This diffuser, ideally, may include directing blades and/or ramps which tend to turn the radial air discharge from the second stage fan 26 to an upwardly directed flow so as to guide and partially diffuse the same to provide a smoothed air flow and reduce air generated noise level.

As already set out, fans 26, 28 are housed within the confines of cylindrical portion 74 of diffuser 70. This is accomplished in the following manner. A motor shaft 78 of motor 22 extends therefrom in a downward direction into the space defined, in part, by the cylindrical portion 74 of diffuser 70, with the fans 26, 28 mounted fast to the shaft 78 to rotate with the shaft by a shaft nut 80 threaded on the bottom of shaft 78. An upwardly disposed diffuser 82 (the first stage diffuser) which takes radially discharged air from fan 28 and directs it to the eye of fan 26, is mounted inwardly of the fan 26, within the spaced afforded by cylindrical portion 74 of diffuser 70.

This diffuser also includes a bottom plate 82 to which is integrally joined a thin-walled, vertically and axially inwardly extending cylindrical portion 84, terminated by an upwardly, outwardly extending, overturned rim portion 86. This rim portion centers the first stage diffuser 82 relative to the space afforded by the second stage diffuser 70 by mating engagement against outwardly extending, overturned rim portion 88 of a motor mounting plate 90, the motor mounting plate being fixed with respect to a motor shell 92 of motor 22 by a series of bolts 94, 94 (only one shown). Downward or outward movement of diffuser 82 is prevented by its seating upon the top of the blading of diffuser 70 with the ramps thereof maintaining it laterally.

In order to assembly the first stage diffuser 82 and the motor mounting plate 90 in fixed relation to the second stage diffuser 70, a series of three spring clips 96, 96, 96 (only one shown), generally C-shaped in cross section, and with rim-receiving portions 98, 98, generally at the tips or terminations of the curve of the "C" are provided. These clips engage over the mated rim portions 86, 88 of the first stage diffuser 82 and motor mounting plate 90, respectively, at their tops, and over a rim portion 100, integral with and extending annularly around the bottom of second stage diffuser 70, at their bottoms. The motor 22, motor mounting plate 90, first stage diffuser 82, fan 28, second stage diffuser 70, and fan 26 are thereby actually one assemblage resting on and resiliently supported by resilient ring member 62.

The second or upper resilient suspension means is formed by a second or upper resilient ring member 102 formed in substantially the same way as lower resilient ring 62 to thereby contain spheres 64, a horizontal joining ring 104, similar to the horizontal ring 66 of resilient ring member 62, but of smaller internal and external diameter, and a vertical joining ring 106 similar to the vertical ring 68 of resilient ring member 62, but of smaller internal and external diameter, with a pair of sealing faces 107, 107 on the upper and lower terminations of ring 106. Because of this last mentioned difference in diameters, the horizontal lateral extents of resilient ring members 62, 102, respectively, are transversely offset so that the total horizontal-extent effect of these ring members is much greater than the horizontal extent of either, singly. Thus, the resilient force provided against vibration-induced rocking, works over a larger lateral or horizontal extent, yielding a resilient vibration dampening effect, substantially, of a resilient support or supports of a continuous transverse extent equal to the sum of the transverse horizontal extents of both resilient rings 62 and 102.

Further, because of the relative disposition of these rings, the larger one essentially below and radially inward of the periphery of diffuser 70, and the other, smaller one, further inward from the periphery of diffuser 70 and mounted in a grooved portion 108 of intermediate shell 14, resting on a curved surface 91 formed in motor mounting plate 90, permits the use, overall, of a relatively small diameter assemblage for the resilient mounting means, fans, diffusers and motor.

As set out above, the vibration isolation of the motor 22 and fan system 24 from the canister cleaner housing 12 is completed by the upper resilient ring member 102 that seats in the receiving grooved portion 108, formed in and extending annularly around the bottom portion of the intermediate shell 14, proximate its inner termination. Thus, the upper resilient ring member prevents the transmission of vibrations and noise to those portions of the cleaner housing 12 thereabove including the intermediate shell 14, situated most closely adjacent to it, and the upper shell 16 and medallion section 20. At the same time, lower resilient ring member 60 prevents passage of noise and vibration to the bottom pan 18 and thence to the remainder of the cleaner housing through a series of connecting studs 51, 51, 51 (only one shown).

These studs are assembled to the canister cleaner 10 in the following manner. Each of the studs is projection welded into the bottom pan 18 so as to extend upwardly through a series of small bores 110, 110, 110 (only one shown) in intermediate shell 14 so that a series of nuts 112, 112, 112 (only one shown) may be mounted on their extended ends and drawn tight to provide a compressive force to the lower and upper resilient mounting ring members 62, 102, respectively, to insure that the motor-fan arrangement is functionally, resiliently sandwiched by these resilient means. Tightening of each of the nuts 112 performs another important function; as the lower and upper resilient means compress, they each tend to distort into a flatter, solider ring configuration pressing the faces 69, 69 and 107, 107 into tighter sealing engagement. Then, because of their locations, essentially above and below the fan system, the resilient ring members serve their secondary, albeit as important, sealing function to insure proper air flow within the cleaner 10.

The operation of the canister cleaner 10 should now be apparent. A part of the air stream flow (suction cleaner air) as set out earlier, enters motor housing 38 for cooling of the motor. Such entrance is gained through a series of elongated apertures, e.g., 114, 116 and 118 in the top of motor housing 38 (note the air indicating arrows). This air then passes inwardly into motor 22 through a series of circumferentially disposed apertures (not shown) in the top of its shell casing 92 and also through apertures (not shown) in the bottom side 120 of the casing 92 to first stage fan 28, first stage diffuser 82, and then second stage fan 26.

In order to lower the discharge temperature of this cleaner suction air, it is then mixed with outside ambient air which moves through a series of perforations 122 in bottom pan 18, a series of apertures 124 in the bottom face of second stage diffuser 70, from whence it passes along the back face of the second stage fan 26 to merge with the suction cleaner air discharged from this fan.

The outside ambient air, utilized for the mixing, may be induced by a "Viscous" fan formed by the back face of fan 26, by a series of outwardly extending blade tabs used in the assembly of the blades of fan 26 to the front and back faces of the fan or obviously, by another or third fan mounted outwardly and downwardly from fan 26, or merely by the induced air stream motivated (aspirated) by the movement of the primary suction cleaning air. In the instant invention the tabs 125 are utilized as the auxiliary air fan means.

The combined flow of air moves through the diffuser 70 and is discharged into a chamber 126 formed between the diffuser 70, the motor mounting plate 90, and the bottom face of intermediate shell 14, at which time it changes direction by 180° to move downwardly between the second-stage diffuser 70 and bottom face of the intermediate shell. Air is finally discharged upwardly around the periphery of canister cleaner 10, between the termination of the top face of bottom pan 18 and lower, outer face portions of intermediate shell 14 through an opening 128. This upward discharge induces a flow of ambient air into its stream so that the discharge air is again mixed with ambient air, with the whole being dissipated over a wide flow area to eliminate unwanted drafts. It should also be noted that no unwanted backflow or significant leakage of air occurs during movement of the air through the fan system 24 or through the cleaner volume leading to discharge through opening 128 since the resilient ring members 62 and 102 sealingly prevent this at those locations when leakage is most likely to occur. Thus, a highly effective cleaner of the "high" performance type is obtained and fully satisfied by the foregoing description.

DESCRIPTION OF THE SECOND EMBODIMENT

In the description of the second embodiment, like numerals are utilized for like parts contained jointly in it and the first embodiment of the invention and primed numerals are utilized for modified parts.

Figure 5:
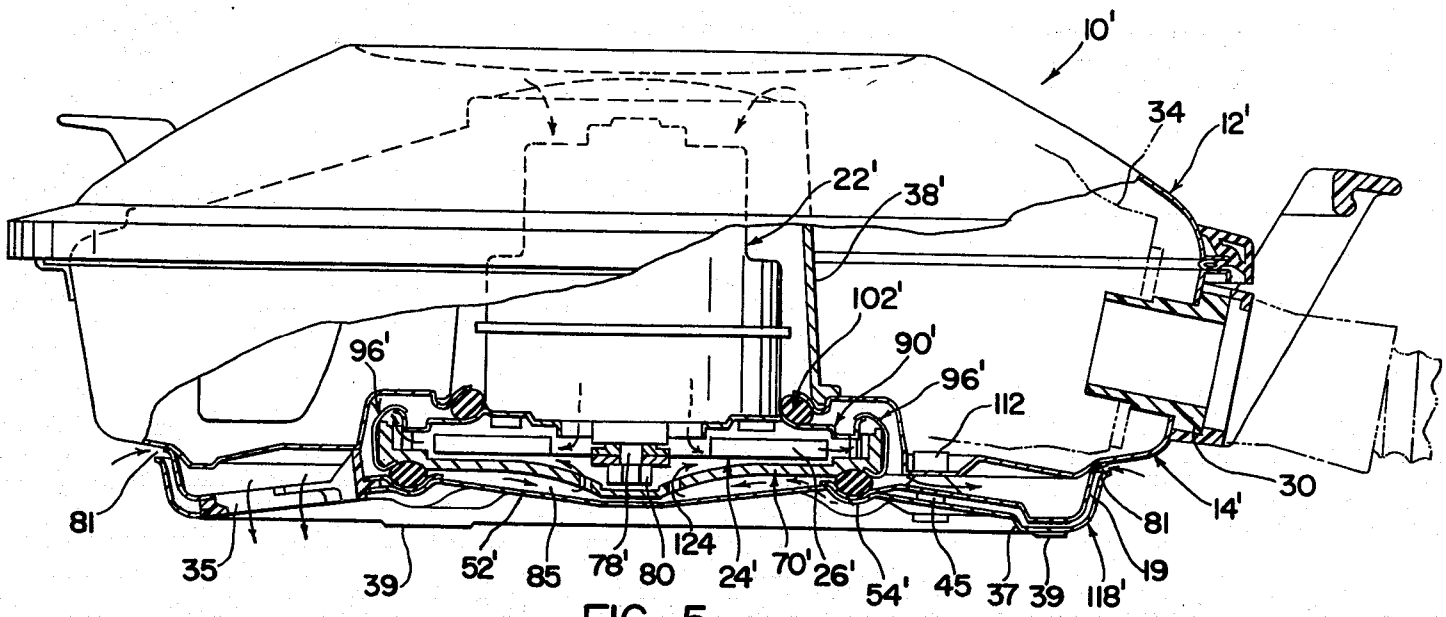
FIG. 5 is an elevational, cross-sectional view of the second embodiment of the invention.
Figure 6:
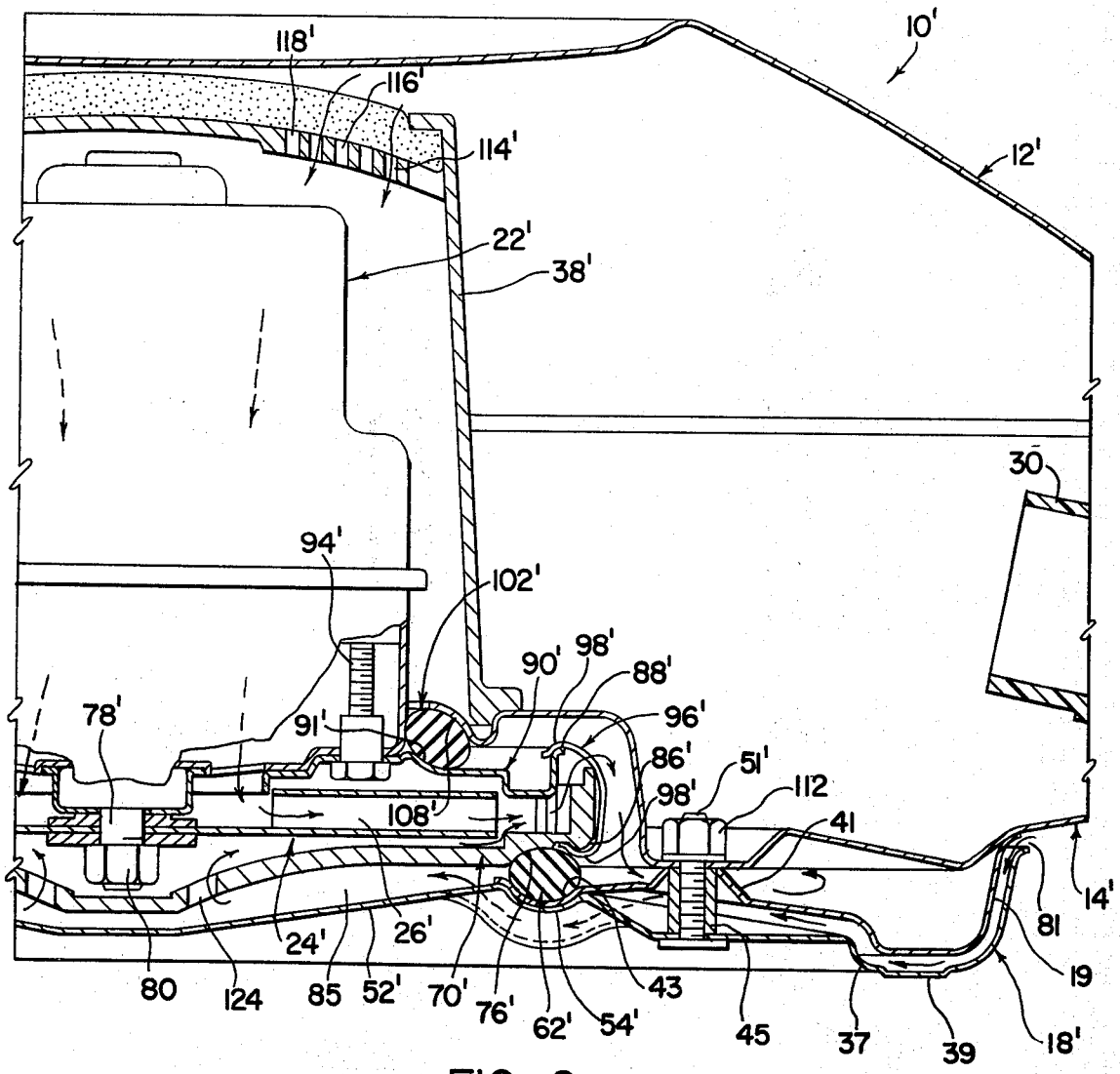
FIG. 6 is a fragmentary, elevational, cross-sectional view of a portion taken at a slightly different location than FIG. 5 and with the same enlarged.

Refering now to FIGS. 5 and 6, it can be seen that a canister cleaner 10' is provided having a housing 12' including an intermediate shell 14' and a bottom pan 18' and an intermediate pan 19 disposed between the bottom 18' and lower portions of the intermediate shell 14'. Conveniently disposed within the housing 12' is a motor 22' that provides a driving force for a fan system 24' including a single fan 26'.

A hose coupling fitting 30 communicates with the interior of the housing 12' to permit the flow of suction cleaner air to pass into a disposable dirt-collecting bag 34 and from thence through the motor 22' to cool it and then through the fan 26'. Air is eventually discharged out the bottom of the cleaner through a blower opening 35 so that an "air ride" is obtained by a cushion of air formed under the bottom pan 18' of the housing 12'.

Again, in so far related, the general configuration of canister cleaner 10' is conventional, with the inventive aspects of this second embodiment yet to be described. Proceeding now with that description, fan system 24' and electric motor 22' receive their support from the bottom pan 18' through the aegis of a bottom, annularly shaped, integral rim portion 37 of bottom pan 18', situated generally near its outer, lowermost portions and extending downwardly from the remainder of bottom pan 18'. Bottom rim portion 37 has extended flattened spots 39, 39, 39 (only one shown) on which the canister cleaner 10' rests when not operating. When cleaner 10' is operative and air is discharging through blower opening 35, the bottom rim portion 37 forms the confines for the air cushion on which cleaner 10' rides. Bottom pan 18' also includes a central, partially domeshaped portion 52' and a receiving grooved portion 54', disposed radially outwardly of the domed portion 52' to complete its general configuration.

Disposed immediately above the bottom pan 18' is the intermediate pan 19. This last-named pan is vertically spaced from, but conforms generally in configuration to bottom pan 18' at its outer, radial portions and maintains this vertical spacing, except for a series of three bolt-receiving indents 41, 41, 41 (only one shown) and except at an inner terminating, receiving grooved portion 43 extending annularly around intermediate pan 19 and abuttingly and matingly engaging within grooved portion 54' of bottom pan 18'.

A lower resilient ring member 62', similar to the ring member 62 but of a differing diameter, is disposed above intermediate pan 19 and is lodged in grooved portion 43 so as to resiliently mount a diffuser 70' of disked, horizontal extent that may have, as in the first embodiment, vanes or blades (not shown) which turn the radially discharged air from fan 26' axially. Diffuser 70' also includes a receiving grooved portion 76', which conforms generally to the upper, outer periphery of resilient ring member 62' so that the resilient ring member 62 is securely located, relative to the bottom pan, intermediate pan and diffuser by the receiving groove portions 43, 54' and 76'. A series of projection welded studs 51', 51', 51' (only one shown) and a series of spacers 45, 45, 45 (only one shown) maintain this structural relationship.

A motor mounting plate 90' of generally annular configuration is attached to motor 22' by a series of bolts 94', 94' (only one shown) and includes a curved portion 91' shaped to support and conform to a bottom portion of an upper resilient ring member 102'. Motor mounting plate 90' registers with diffuser 70' in the same manner as mounting plate 90 registers with diffuser 70 in the first embodiment (through the ramps and blades of diffuser 70') and also includes a rim portion 88' shaped to conform to upper rim-receiving portions 98' of C-shaped spring clips 96'.

For upward seating of a resilient ring member 102', a bottom portion of intermediate shell 14' includes a downwardly opening, receiving grooved portion 108' which is situated close to the radially lower, inner termination of intermediate shell 14'. Thus, once the intermediate shell 14', intermediate pan 19, and bottom pan 18' have been tightly assembled together through the aegis of a series of nuts 112, 112, 112 (only one shown), each tightened on a stud 51', the resilient ring members 62' and 102' are compressed to provide not only a sandwiching resilient mounting means for the fan system 24', but also a pair of sealing means to prevent back flow or significant leakage of the air stream in that part of the cleaner 10' encompassed by the fan, diffuser, and discharge.

It should be clearly pointed out here that the ring members 62' and 102' are configured exactly like ring members 62 and 102 and include solid spheres joined by a thin horizontal ring and a thicker vertical ring, these rings dividing the spheres substantially into sphere quadrants. Also, the vertical ring includes upper and lower sealing faces so that the function and effect of these sealing rings is substantially the same as that given by the sealing rings 62 and 102.

In order to maintain motor mounting plate 90' and diffuser 70' in assembled relation, each C-shaped spring clip 96' also includes a lower rim-receiving portion 98' that engages over a rim portion 86' of diffuser 70'. Thus, the inherent spring force of C-shaped spring clips 96', 96', 96' prevents separation of motor 22', fan 26' and the diffusers 70' so that these structures of canister cleaner 10' comprise a single assemblage. Fan 26' is, of course, similar to the first embodiment, held fast to a motor shaft 78' by a shaft nut 80 mounted thereon.

Suction cleaner air within canister cleaner 10' flows from the dirt-collecting bag into a motor housing 38' of motor 22' through a series of elongated apertures, e.g., 114', 116' and 118' in motor housing 38' and then passes through the motor 22' in the manner described relative to the first embodiment and enters the eye of the fan 26' to be discharged therefrom. At the same time, a flow of induced, cooling ambient air is provided to cool the discharge of the hot suction cleaner air by gaining entrance to the cleaner through a peripheral opening afforded by the space between bottom pan 18' and intermediate pan 19.

This cooling air passes between these two elements as they extend beneath the first resilient ring member 62' and then is discharged into a space 85, between the bottom face of diffuser 70' and the top surface of bottom 18. The cooling air is then induced to flow through a series of apertures 124 in diffuser 70' where it mixes with the discharge air from fan 26' and the mixed air then flows through diffuser 70' to be discharged between the bottom face of intermediate shell 14' and the top face of intermediate pan 19. Air is eventually discharged to atmosphere through the blower opening 35, as set out previously.

It should be evident that the embodiments described clearly and satisfactorily fulfill all the advantages of the invention set out in the beginning portion of the description. Further, it should be apparent that many modifications could be obviously made to the embodiments described which would still fall within their spirit and confines.

What is claimed is:

1. A floor care appliance having an auxiliary, cooling air flow for reducing air discharge temperature from said floor care appliance including;

a. a mounting plate means for supporting said floor care appliance, said mounting plate means being generally pan shaped and extending generally horizontally, b. a diffuser mounted with said mounting plate means and extending generally horizontally, c. a fan means situated in and supported by said diffuser and discharging hot main stream cleaner air to said diffuser, d. said diffuser being in the general shape of a horizontally extending disk, e. said disk shape of said diffuser having vertically upwardly opening apertures extending therethrough for the introduction of an induced, cooling flow of ambient air, said ambient air directly mixing with said hot main stream cleaner air being discharged from said fan means whereby the combined stream of air has a lowered, more acceptable discharge temperature, f. a resilient, compressible sealing element disposed between said mounting plate means and said diffuser and abutting said diffuser for positively resiliently supporting said diffuser and said fan means spacedly above said mounting plate means by being compressed between said diffuser and said mounting plate means, g. said diffuser and said mounting plate means forming at least portions of a passageway therebetween only for the passage of said cooling air flow, said resilient, compressible sealing element sealing said passageway, and h. said cooling air flow receiving entrance to said floor care appliance through means formed at least partly by said mounting plate means.

2. The floor care appliance having an auxiliary, cooling air flow as set out in claim 1 wherein;

a. said auxiliary, cooling air flow receives entrance to said diffuser through upwardly vertically opening aperture means in said mounting plate means.

3. The floor care appliance having an auxiliary, cooling air flow as set out in claim 1 wherein;

a. a supplemental mounting plate means for lending support to said floor care appliance is disposed inwardly of the floor care appliance relative to said mounting plate means, generally pan shaped and extending generally horizontally, and b. said auxiliary, cooling air flow receives entrance to said diffuser through a generally horizontal passageway fromed between said mounting plate means and said supplemental mounting plate means.

4. A canister cleaner including;

a. a bottom member supporting said cleaner and forming a generally horizontal pan-like configuration, said bottom member including apertured portions providing for the entrance of a flow of cooling air to the cleaner, the apertures in said apertured portions opening vertically upwardly, b. a fan means for moving a flow of cleaner air through said cleaner, said fan means also providing said flow of cooling air, c. said cooling air mixing with said cleaner air immediately downstream of said fan means, d. a diffuser for said fan means and supporting the same, said diffuser including vertically upwardly opening apertures, said flow of cooling air moving through said last named apertures for said mixing with said flow of cleaner air, and e. an elastomeric ring disposed between said bottom member and said diffuser and abutting said bottom member and said diffuser to be compressed therebetween to resiliently mount said diffuser and said fan means and to space said diffuser from said bottom member to form a passageway therebetween for the flow of only said cooling air.

* * * * *

UNITED STATES PATENT OFFICE
CERTIFICATE OF CORRECTION

Patent No. 3958299 Dated 25 May 1976

Inventor(s) Donald B. Tschudy

It is certified that error appears in the above-identified patent and that said Letters Patent are hereby corrected as shown below:

Column 5, line 39, "82" should be -- 83 --; line 53, "assembly" should be -- assemble --. Column 10, line 45, -- said supplemental mounting plate means being -- should appear before ", generally"; line 49, "fromed" should be -- formed --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*